United States Patent [19]

Bahry et al.

[11] 4,154,070

[45] May 15, 1979

[54] LOCKING ARRANGEMENT FOR DOORS AND THE LIKE

[76] Inventors: Abraham Bahry; Moshe Dolev, both of 45, Sokolov St., Cholon, Israel

[21] Appl. No.: 848,106

[22] Filed: Nov. 3, 1977

[51] Int. Cl.[2] ..... E05B 59/00; E05B 63/14; E05C 1/06; E05C 1/12

[52] U.S. Cl. ..... 70/108; 70/120; 292/39; 292/142; 292/172

[58] Field of Search ..... 70/120, 119, 107, 108; 292/36, 39, 40, 142, 172

[56] References Cited

U.S. PATENT DOCUMENTS

| | | | |
|---|---|---|---|
| 788,952 | 5/1905 | Schwegler | 292/36 |
| 3,776,581 | 12/1973 | Ross | 292/39 |
| 3,991,595 | 11/1976 | Bahry | 70/120 |
| 4,037,440 | 7/1977 | Shabtai | 70/108 |

*Primary Examiner*—Robert L. Wolfe
*Attorney, Agent, or Firm*—Alter and Weiss

[57] ABSTRACT

A locking arrangement using an actuating gear mounted on a cylinder lock for turning a gear wheel having locking bolt means linked thereto for movement to locked and unlocked positions responsive to movement of the cylinder of the cylinder lock. A spring-biased latch normally in the locked position is further provided which can be moved to the unlocked position, when the locking bolt means is in the unlocked position either by separate handle or by the further movement of the cylinder.

6 Claims, 7 Drawing Figures

LOCKING ARRANGEMENT FOR DOORS AND THE LIKE

The present invention concerns locks of the type in which an actuating gear is mounted on the cylinder of a cylinder lock and is adapted, when turned by the key, to actuate at least two locking bolts into locking or unlocking position through the intermediary of curved links pivoted to a toothed wheel with which said gear is meshed.

This type of lock will hereinafter be designated as a lock of the kind defined.

There is known a locking arrangement for doors and the like which comprises, in addition to the known latch bolt which is actuated by either the handle or any cylinder lock, at least one elongated locking bolt at an angle to said latch bolt and adapted to engage a side of the door opening other than that which the latch bolt engages, said locking bolt and said latch bolt being connected by means of curved links to a toothed wheel rotatable by an actuating gear, said gear being keyed on the cylinder of said cylinder lock, and being rotated therewith to lock the bolts.

It is an object of the present application to improve said locking arrangement, providing in addition to a locking bolt on the side of the door opposite to that where the hinge is located, a separate latch which may be actuated by the cylindrical lock or by the handle of the door when the locking bolt is retracted.

In this manner a more secure locking of the door will be assured, and furthermore when the cylindrical lock is in the unlocked position, the door may be opened from the inside by means of the handle or by actuating the cylindrical lock.

The invention consists in a locking arrangement of the kind in which an actuating gear is mounted on the cylinder of a cylinder lock and is adapted, when turned by the key, to actuate at least two locking bolts through arcuate links into locked or unlocked positions. The links are pivotted to a toothed wheel with which said gear is meshed. The locking arrangement is characterized in this, that a spring-biased latch is provided which in the unlocked position of the locking bolt is adapted to be operatively connected to a door knob, or to a second toothed wheel actuated by said cylinder lock in order to be withdrawn.

The above mentioned and other objects and features of the invention and the manner of attaining them will become more apparent and the invention itself will be best understood by making reference to the following description of an embodiment of the invention taken in conjunction with the accompanying drawings, in which.

Figures 1, 2, 3:
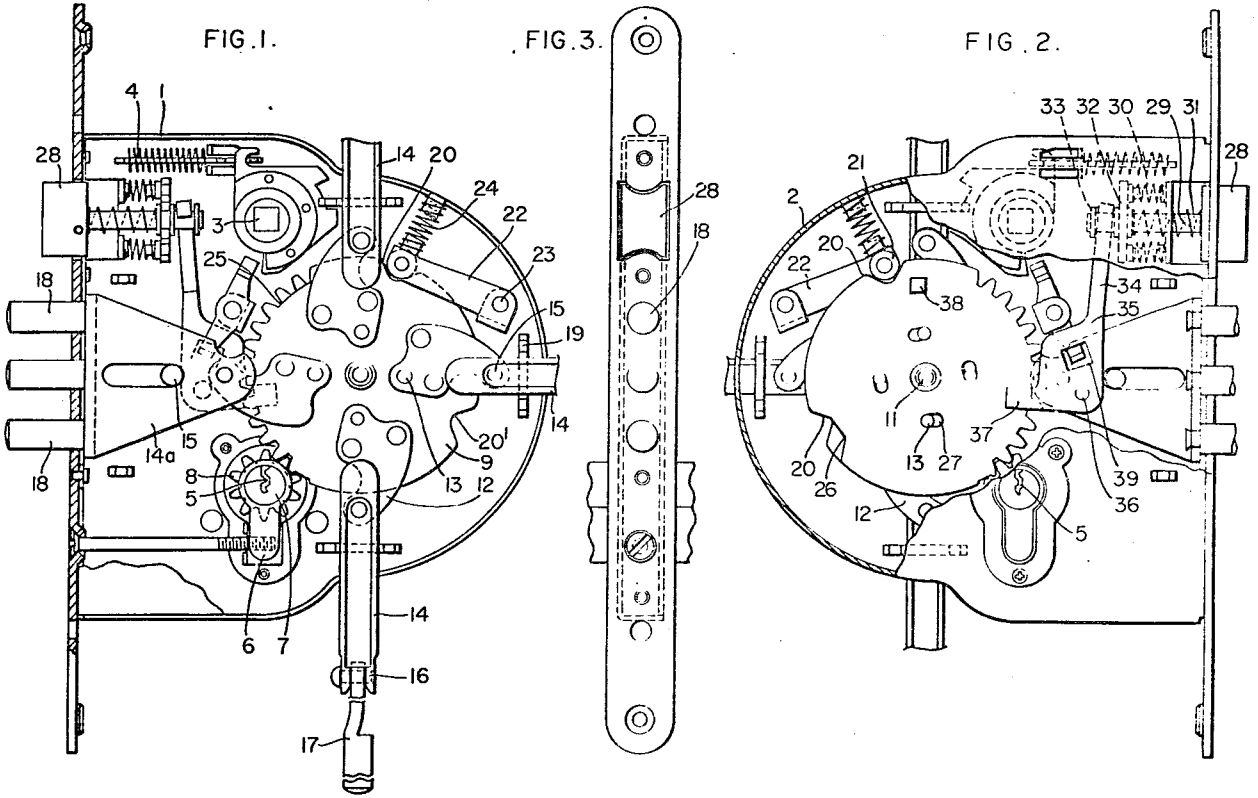
FIG. 1 shows an elevational view of the part of the locking arrangement which faces the outside of a door in the locking position.
FIG. 2 shows a similar view, in mirror symmetry, of the part of the locking arrangement which faces the inside of a door.
FIG. 3 is an elevation of the side ledge of the locking arrangement at the longitudinal side of the door.

The locking arrangement comprises a housing made of two parts, part 1 facing the outside of a door (not shown), part 2 facing the inside. Through housing part 1 a handle shaft 3 biased by a spring arrangement 4, extends as well as a keyhole 5 of a cylindrical lock generally indicated by 6. Through housing part 2 only keyhole 5' extends.

The key (not shown) inserted into keyhole 5 or 5' from either side of the door rotates the cylinder 7 of lock 6. On said cylinder an actuating gear 8 is keyed which is in mesh with two registering toothed wheels or driven gears 9 and 10 mounted on shaft 11. Both driven gears 9 and 10 are provided with teeth over part of their periphery, the teeth being substantially in register as will hereinafter be explained in greater detail. To gear 9 the inner ends of four curved links 12 are pivotally mounted at 13, preferably at equal angular spacings. To the outer ends of links 12 three slotted linking bars 14 are pivotally mounted at 15. The outer ends of linking bars 14 are pivotally attached at 16 in locking bolts 17.

The three locking bolts 17 extend to the three sides of the doors; i.e., the top, bottom and the longitudinal side on which the door is hinged. A fourth slotted linking bar **14*a* extends to the side opposite to the hinged side and is shown substantially in the form of a triangle having three short bolts 18** integrally mounted thereto and extending therefrom.

Link **14*a* may, if desired, be shaped like links 14, and may be connected to one bolt only, or, if desired, link 14*a*** may have only one or two bolts mounted thereto.

Guides 19, which guide the movement of bars 14, and, at the same time, act as spacers between the two parts of the housing, are provided.

Gear 9 is provided at its periphery with two cam depressions 20 which are adpated to be engaged by a cam follower 21 mounted on an arm 22 pivotted at 23 and urged by a spring 24 into depression-engaging position. The peripheral distance between the two depressions 20 corresponds to the limits of the angular movement of gear 9. The teeth of gear 9 are cut away at 25, so that only the teeth of gear 10 extend above this cutaway portion for a purpose which will become clear hereinafter.

Figure 4:
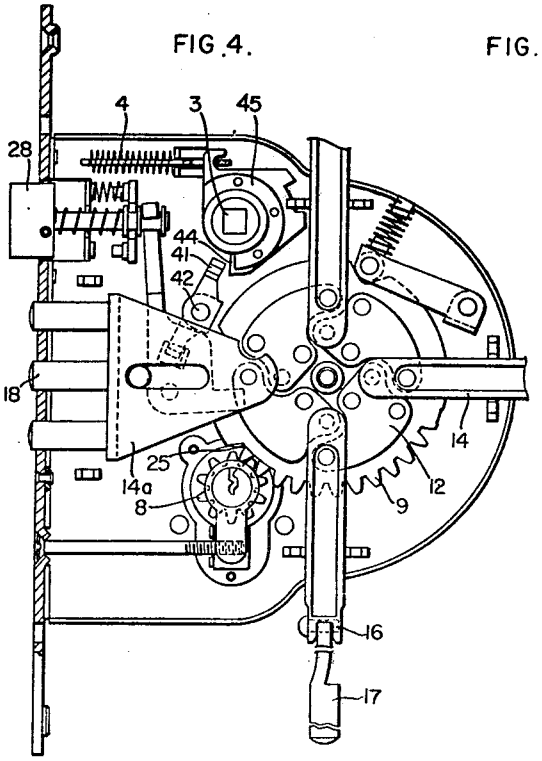
FIG. 4 is a view similar to that of FIG. 1, showing the arrangement in unlocked position.

It can be seen from FIGS. 1 and 4 that as cylinder 7 is rotated gear 9 will rotate likewise and will actuate locking bolts 18 into locking or unlocking position.

Gear 10 is likewise provided with a depression 20 of the same size as that of gear 9 and with a depression 26 which is longer than depression 20'. Gear 9, furthermore is provided with annular slots 27 through which pivots 13 extend, so that gear 10 can rotate slightly further than gear 9.

According to the invention a latch 28 is provided which is, as known per se, biased towards locking position by a spring 29. Two short springs 30 are provided to enable the withdrawal of the latch for turning it over to be used for either lefthanded or righthanded door openings.

Latch 28 is mounted at the end of a bolt 31 which extends through a mounting plate 32 against which spring 29 abuts. The bolt 31 has attached at its end a stop 33.

The upper end of a lever 34 extending upwardly from an operating member 35 engages bolt 31 between plate 32 and stop 33. Member 35 is pivotted at 36 to the housing and is provided with a nose 37 adjacent wheel 10.

On wheel 10 a lug 38 is mounted which is adapted to engage nose 37 of operating member 35 as will hereinafter be explained.

Operating member 35 is likewise provided with a window 39 which engages a nose 40 at one end of a link 41. The link 41 is pivotted to the housing at 42. A lug 43 at the other end of link 41 engages a nose 44 on a plate 45 integral with handle shaft 3.

Figure 6:
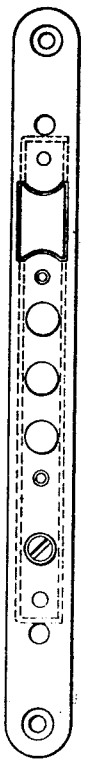
FIG. 6 is an elevation similar to that of FIG. 3.
Figure 7:
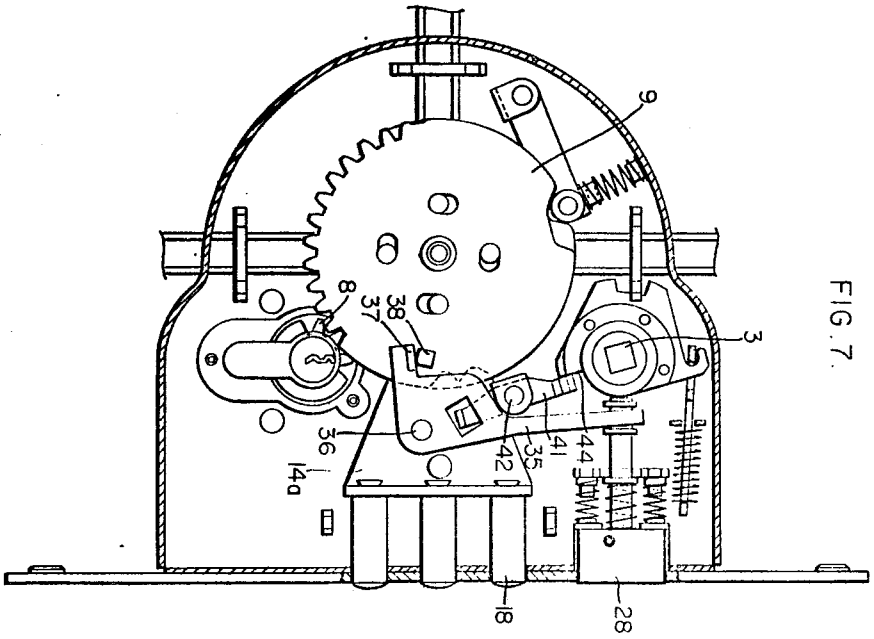
FIG. 7 is a view similar to FIG. 5, illustrating the operation of the latch by a door knob or handle.

In operation gear 9, and gear 10 are turned together to achieve a locking position, as shown in FIGS. 1 - 3. When the lock is turned into unlocking position, shown in FIGS. 4 - 6, gear 10 rotates together with gear 9. However, upon further turning gear 8, gear 9 will remain in place because gear 8 will have ceased to be in mesh therewith owing to cut-away teeth 25, but gear 10 will rotate further since its teeth are in mesh with gear 8. This further rotation, which is relative to gear 9, is possible because of slots 27 and depression 26. The further rotation causes lug 38 to engage nose 37 of member 35 whereby lever arm 34 retracts latch 28. This position is shown in FIG. 7.

Figure 5:
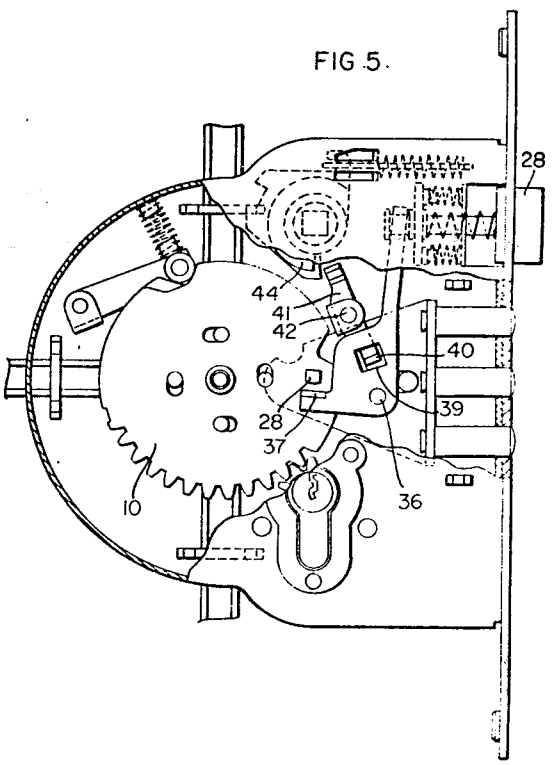
FIG. 5 is a view similar to that of FIG. 2 and in mirror symmetry to FIG. 4.

If, however, in the position shown in FIG. 5 door knob shaft 3 is actuated, nose 44 will engage lug 43 and cause link 21 to pivot operating member 34, so that latch 28 can be retracted by the door knob shaft 3. The link 41 may be operatively connected directly with the bolt 31 of the latch, if desired.

While the principles of the invention have been described above in connection with specific apparatus and applications, it is to be understood that this description is made by way of example only and not as a limitation on the scope of the invention.

We claim:

1. In a locking arrangement of the kind in which an actuating gear is mounted on the cylinder of a cylinder lock and is adapted, when turned by the key, to actuate at least two locking bolts into locking or unlocking position through the intermediary of curved links pivoted to a first toothed wheel with which said gear is meshed, a second toothed wheel substantially in register with said first toothed wheel and mounted on the same shaft, and a spring-biased latch which in the unlocked position of said locking bolts is adapted to be operatively connected to the handle or to said second toothed wheel, both toothed wheels being is mesh with said actuating gear.

2. The improved locking arrangement of claim 1 wherein a portion of the teeth of said first toothed wheel is removed, whereby only the teeth of the second toothed wheel are adapted to be meshed with said actuating gear after the locking bolts are moved to the unlocked position.

3. The improved locking arrangement of claim 2 comprising an operating member pivotally mounted, and means for attaching said operating member to move the latch responsive to movement of said second toothed wheel when only the teeth of the second toothed wheel are meshed with said actuating gear.

4. The locking arrangement of claim 3 wherein said operating member comprises a lever extending therefrom, means for attaching said lever to said latch, an integral nose extending from said operating member, and lug means mounted on said second toothed wheel and positioned to engage said nose for pivoting said operating means to move said latch to the unlocked position.

5. The improved locking arrangement of claim 4 wherein knob means are provided on said door for moving said latch to the unlocked position independently of said cylinder lock, when said locking bolt means are in the unlocked position, window means in said operating member, and pivoted link means having one end extending into said window and the other end of said link means being attached to be moved responsive to the movement of said knob means to thereby pivot said operating member to unlock said latch.

6. The improved locking arrangement of claim 5 wherein one of said locking bolts is located on the same side of the door as said latch, and said one of said locking bolts being substantially in the shape of a triangle and being provided with three short bolts.

* * * * *